United States Patent [19]

Hara

[11] Patent Number: 4,774,934

[45] Date of Patent: Oct. 4, 1988

[54] BUBBLE BATH ASSEMBLY WITH NOZZLE OUTLET ABOVE WATER SURFACE

[75] Inventor: Zenzaburo Hara, Tokyo, Japan

[73] Assignee: Hara Health Industrial Co., Ltd., Tokyo, Japan

[21] Appl. No.: 47,180

[22] Filed: May 5, 1987

Related U.S. Application Data

[63] Continuation-in-part of Ser. No. 855,628, Apr. 2, 1986, abandoned.

[51] Int. Cl.[4] ..... A61H 9/00; A61H 33/02

[52] U.S. Cl. ..... 128/66; 4/544

[58] Field of Search ..... 128/66; 4/544, 542, 4/541

[56] References Cited

U.S. PATENT DOCUMENTS

| | | | |
|---|---|---|---|
| 3,286,712 | 11/1966 | Roden | 4/544 |
| 3,366,110 | 1/1968 | Gaylord, Jr. | 4/541 |
| 3,580,247 | 5/1971 | Schneider | 128/66 |
| 3,585,991 | 6/1971 | Balamuth | 128/66 |
| 3,587,976 | 6/1971 | Jacuzzi | 128/66 |
| 3,641,996 | 2/1972 | Friend | 128/66 |
| 3,806,964 | 4/1974 | Vanegas et al. | 4/542 |
| 3,842,823 | 10/1974 | Jacuzzi et al. | 128/66 |
| 3,961,382 | 6/1976 | Peterson, Jr. | 128/66 |
| 4,100,917 | 7/1978 | Talge et al. | 128/66 |
| 4,127,117 | 11/1978 | Peterson, Jr. | 128/66 |

FOREIGN PATENT DOCUMENTS

| | | | |
|---|---|---|---|
| 0210821 | 2/1987 | European Pat. Off. | 4/541 |
| 2428591 | 1/1976 | Fed. Rep. of Germany | 128/66 |
| 561059 | 4/1975 | Switzerland | 128/66 |

*Primary Examiner*—David Wiecking
*Assistant Examiner*—Tonya Lamb
*Attorney, Agent, or Firm*—Kane, Dalsimer, Sullivan, Kurucz, Levy, Eisele and Richard

[57] ABSTRACT

A bubble bath assembly disclosed is designed to be installed in the vicinity of the side wall of a conventional bathtub and includes a pump, a suction pipe, a nozzle and a support housing. The pump has an inlet and an outlet. The suction pipe is connected to the inlet of the pump, and is adapted to be disposed within the bathtub. The nozzle is connected to the outlet of the pump. The support housing holds the nozzle in order to retain the nozzle over the water in the bathtub upon the installment of the assembly. When the pump is operated, water is drawn into the pump from the bathtub through the suction pipe, and is discharged in a jet from the nozzle against the surface of the water in the bathtub. This jet of water introduce oxygen into the bath water, resulting in the formation of a layer of minute bubbles over the surface of the bath water. When these innumerable bubbles break, they generate ultrasonic waves which help in preventing the human body from suffering from skin diseases and muscular pains.

5 Claims, 4 Drawing Sheets

BUBBLE BATH ASSEMBLY WITH NOZZLE OUTLET ABOVE WATER SURFACE

BACKGROUND OF THE INVENTION

This is a continuation-in-part to U.S. Pat. Application Ser. No. 855,628, filed Apr. 2, 1986 and now abandoned.

This invention relates to a bubble bath assembly which generates a multiplicity of minute bubbles in the water in a bathtub.

It has been known for a long period of time that spa treatment is good for vitalizing and maintaining your health. Even today, a large number of people visit hot springs to receive the spa treatments. However, for the people living in the city, it is inconvenient to go to these hot springs since most of the hot springs are located in the country side. Moreover, if the hot spring, where you can take a suitable spa treatment, is located very far from where you live, it takes both a great amount of time and great expense to get there. Therefore, not many people are able to have spa treatments at their convenience.

Hydrotherapy bath assemblies conventionally in use may, in fact, create a relaxing, soothing effect in the bath water without hot spring water, since these conventional assemblies have nozzles disposed in the bath water for generating swirls or whirlpools in the bath water. However, the medicinal effects of these swirls or whirlpools are not as excellent as that of a natural hot spring water bath.

SUMMARY OF THE INVENTION

Accordingly, it is an object of the present invention to provide a bubble bath assembly which is capable of creating, in a bathtub, a similar excellent healing effect as that of hot spring waters do.

With this and other objects in view, the present invention provides a bubble bath assembly comprising pump means, a suction pipe member, a nozzle member and support means. The pipe member has an inlet and an outlet. The suction pipe member is connected to the inlet of the pump means, and is adapted to be disposed within a bathtub. The nozzle member is connected to the outlet of the pump means. The support means holds the nozzle member in order to retain the nozzle member over the water in the bathtub when the bubble bath assembly is installed in the vicinity of the side wall of the bathtub. When the pump means is operated, water is drawn into the pump means from the bathtub through the suction pipe member, and is discharged in a jet from the nozzle member against the surface of the water in the bathtub. This jet of water introduces oxygen ino the bath water, resulting in the formation of a layer of minute bubbles covering the surface of the bath water. When these innumerable bubbles break, they generate ultrasonic waves which enhance the heat transfer rate between the bath water and the human body and raise the bone's temperature so that it is higher than the flesh's temperature. Also, the ultrasonic waves massage the human body and promote the removal from the skin of dirt and oils which clog the pores of the skin. These effects of the ultrasonic waves help in preventing the human body from suffering from skin diseases and muscular pains just as hot springs do.

The support means may be a housing which encloses the pump means and is designed to be mounted on the wall of a bathroom in which the bathtub is installed. Preferably, the housing includes: a base portion to be attached to that portion of the wall of the bathroom higher than the upper edge of the side wall of the bathtub; and an overhang portion having a lower face and projecting from the base portion horizontally over the water in the bathtub. In this case, the nozzle member is attached to the lower face of the overhang portion of the housing so that the outlet of the nozzle member is directed downward when the assembly is mounted on the wall of the bathroom.

Alternatively, the support means may be a housing designed to be mounted on the upper edge of the side wall of the bathtub. In this case, it is preferred that the housing includes: a base portion having a bottom face to rest on the upper edge of the side wall of the bathtub; and an overhang portion projecting from the base portion horizontally over the water in the bathtub. The overhang portion has a lower face which is, upon the mounting of the housing, to be positioned at a higher level than the bottom face of the base portion. The nozzle member is attached to the lower face of the overhang portion so that, upon the mounting of the housing, the outlet of the nozzle member is also positioned at a higher level than the bottom face of the base portion.

A silencer tube may be coaxially attached at one of its ends to the nozzle member for the reduction of noise due to the jet of water. The silencer tube must have an axial length such that at least the other end of the silencer tube is immersed in the water in the bathtub upon the mounting of the housing and the filling up of the bathtub with water. This silencer tube may have an air intake hole formed in its upper end portion, for allowing the external air to come into the silencer tube therethrough. When water is discharged in a jet from the nozzle member, the jet of water draws external air through the air intake holes of the silencer tube, introducing it into the bath water.

DETAILED DESCRIPTION OF THE PREFERRED EMBODIMENT

Figure 1:
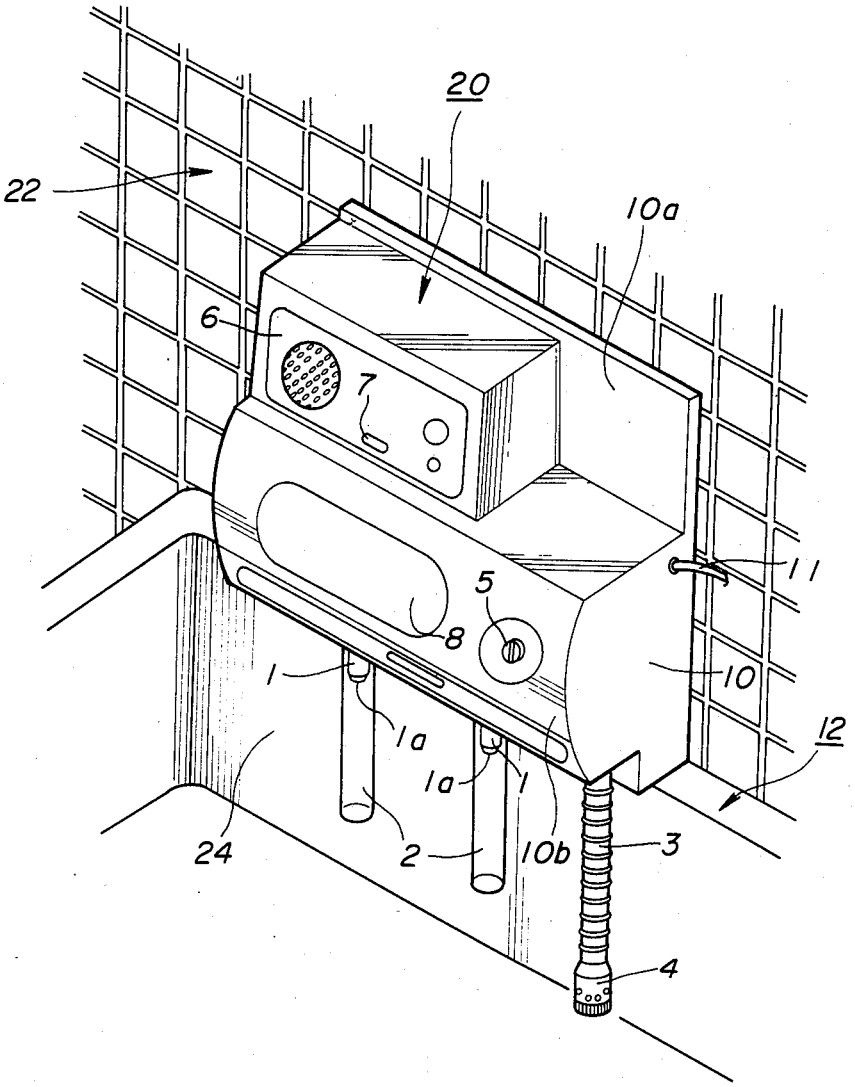
FIG. 1 is a perspective view of a bubble bath assembly according to the present invention, showing the bubble bath assembly mounted on the wall of a bathroom.

Referring now to the drawings, wherein like reference characters designate corresponding parts throughout several views, and descriptions of the corresponding parts are omitted once given.

Figure 2:
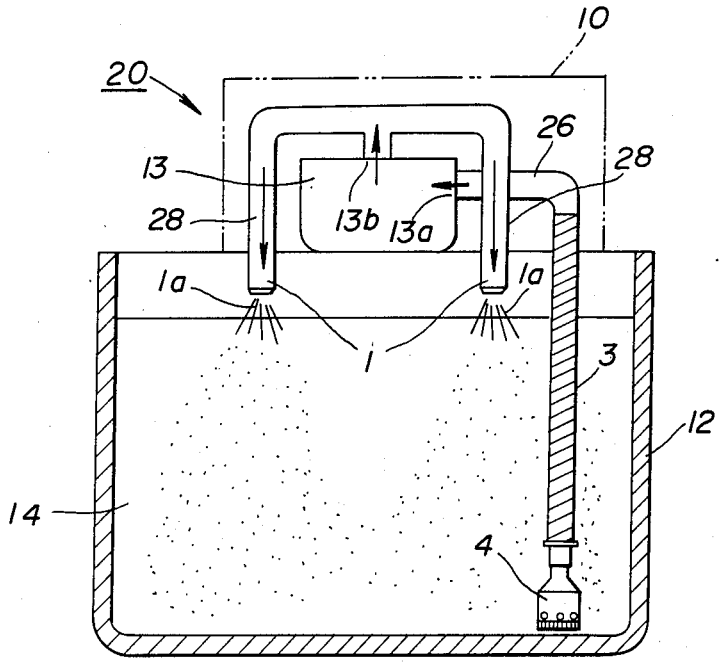
FIG. 2 is a schematic front view of the bubble bath assembly in FIG. 1, also showing a bathtub in section.

In FIGS. 1 and 2, reference numeral 20 designates a bubble bath assembly embodying the principle of the present invention, and reference numeral 12 denotes a bathtub which is installed adjacent to a wall 22 of a bathroom. The bubble bath assembly has a housing 10 in which there are enclosed a pump hereinafter described and a electric motor (not shown) for actuating the pump. This housing 10 has a panel-like base portion 10*a* and a box-like overhang portion 10*b*. The base portion 10*a* is fixed on that portion of the wall 22 which is at a higher level than the upper edge of the side wall 24 of the bathtub 12, while the overhang portion 10*b* projects perpendicularly from the base portion 10*a* and overhangs the bathtub 12. The lower face of the overhang portion 10b is positioned at a higher level than the bottom face of the base portion 10*a* which, as shown in FIG. 1, rests on the upper edge of the side wall 24 of the bathtub 12.

As shown in FIG. 2, within the housing 10 is rigidly mounted a pump 13, which draws water 14 through a suction pipe 3 disposed in the bathtub 12, and discharges it through two nozzles 1 disposed over the water 14 in the bathtub 12. The suction pipe 3 is connected at its upper end to the inlet 13*a* of the pump 13 by a conduit 26, and passes out of the housing 10 through an aperture formed in the lower face of the overhang portion 10*b* of the housing 10. The pipe 3 is, then, extended downward to the bottom of the bathtub 12, and provided at its lower end with a capsule-encased filter 4. On the other hand, the two nozzles 1 are fixedly secured to the lower face of the overhang portion 10*b* of the housing 10, with their outlets 1*a* (which are at the lower ends of the nozzles 1) directed downward. These nozzles 1 are connected at their inlets to the outlet 13*b* of the pump 13 by a branch pipes 28. The nozzles 1 project downwards from the overhang portion 10*b*, but their vertical lengths are such that the nozzles' outlets 1*a* are retained at a higher level than the surface of the water 14 so that the outlets of the nozzles are distances from the surface of the water 14 in the bathtub 12.

Figure 3:
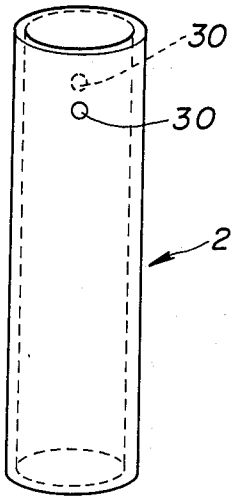
FIG. 3 is an enlarged perspective view of a silencer tube in FIG. 1.

Returning to FIG. 1, a silencer tube 2 is coaxially and detachably joined at its upper end to each of the nozzles 1. This joint section between the silencer tube 2 and the corresponding nozzle 1 is achieved, for example, by both a thread formed on the outer face of the tube 2 and a thread formed on the outer face of the nozzle 1. The silencer tube 2 is of a length such that at least the lower end of the silencer tube 2 is immersed in the water in the bathtub 12. When the water is discharged from the nozzles 1, each tube 2 serves as a silencer for the reduction of noise that is due to the collision between the discharged water and the water in the bathtub 12. As illustrated in FIG. 3, the silencer tube 2 has a pair of air intake holes 30 formed in its upper end portion so that the external air is taken into the tube 2 through the holes 30 upon discharging of the water from the corresponding nozzle 1.

An off/on switch 5 is mounted on the front face of the overhang portion 10*b* of the housing 10 for controlling the operation of the pump 13. A waterproof radio 6 with a digital watch 7 is mounted on the upper face of the overhang portion 10*b* of the housing 10. A thermometer 8 and a mirror 9 are mounted on the front face of the overhang portion 10*b* of the housing 10. An electric cord 11, which connects the electric motor in the housing 10 to an electric power source, passes out of the housing 10 through the side face of the overhang portion 10*b* of the housing 10.

The operation of the bubble bath assembly thus constructed will now be described. When the switch 5 is turned on, the pump 13 is actuated by the motor. Then, the water 14 in the bathtub 12 is drawn into the pump 13 through the suction pipe 3 and is pressurized by the pump. The pressurized water is, then, supplied to the nozzles 1 and is subsequently discharged in a jet from the nozzles 1 against the surface of the water 14 in the bathtub 12. When the jet of water impinges on the surface of the water 14, the atmospheric pressure around the jet of water decreases due to the impact of the impinging waters, causing oxygen in the atmosphere to be introduced into the water 14 in the bathtub. This results in the formation of a layer of minute bubbles covering the whole surface of the water 14 in the bathtub 12 as well as the generation of a multiplicity of minute bubbles suspended throughout the water 14. When these innumerable bubbles in the water 14 contact the human body immersed in the water 14, they break instantly, and generate ultrasonic waves throughout the bathtub 12. These ultrasonic waves enhance the heat transfer rate between the bath water 14 and the human body, massage the human body and promote the removal of dirt and oils from the skin of the human body, which help in preventing the human body from suffering from skin diseases and muscular pains just as natural hot springs do.

Figure 4:
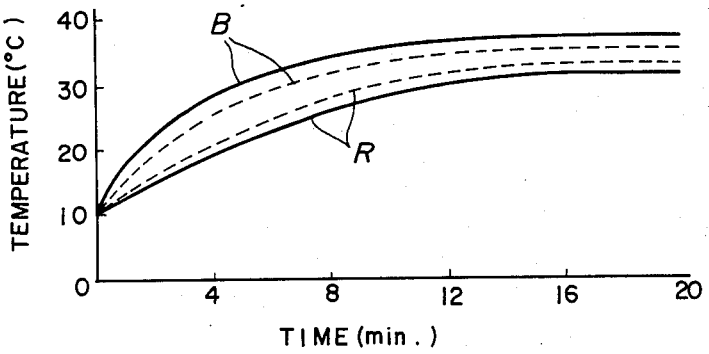
FIG. 4 is a graph showing the relationship between the duration time of a rooster's bath and the temperature of the rooster's feet immersed in a bubble bath water prepared by using the bubble bath assembly in FIG. 1.

The heat transfer tests were carried out for both a regular bath and a bubble bath prepared by using the aforementioned bubble bath assembly. Each test is performed as follows: A bathtub having a capacity of about 200 liters was filled with water having a temperature of 40° C. A rooster's feet were immersed and restrained in the water in the bathtub. The temperatures of both the flesh and the bone of the rooster's feet were checked for 20 minutes after the immersion. In the bubble bath test, water under a pressure of 0.5 $kg/m^2$ was constantly discharged against the bath water with a flow rate of about 70 to 80 liter/min., whereby over the bath water, there was formed a layer of bubbles having a thickness of about 2 to 3 cm, in which the bubbles generated ultrasonic waves with a frequency of about 80,000 to 100,000 Hz. The results are plotted in FIG. 4 in which the solid line and the dotted line, both indicated by letter B, designate respective curves of the bone and the flesh of the rooster's feet in the bubble bath, while the solid line and the dotted line, both indicated by letter R, designate respective curves of the bone and flesh of the rooster's feet in the regular bath.

Figure 5:
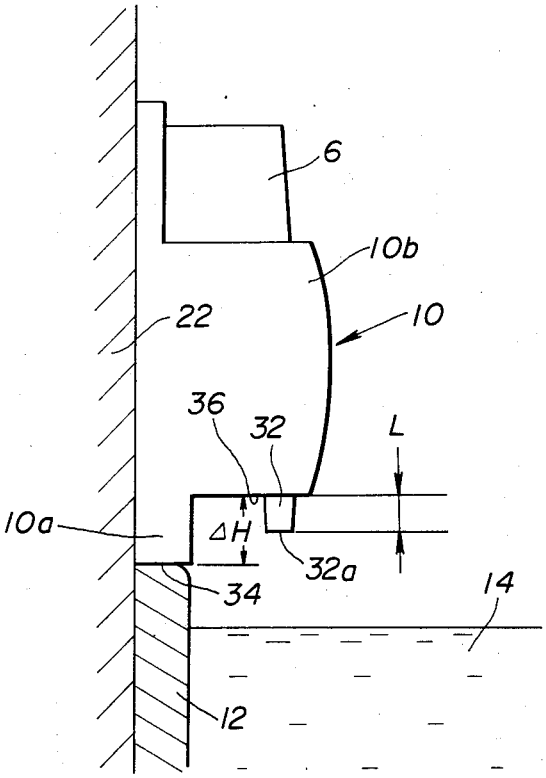
FIG. 5 is a side-elevational view of a modified form of the bubble bath assembly in FIG. 1.

FIG. 5 illustrates a modified form of the bubble bath assembly in FIG. 1, in which each of the nozzles 32 has an axial length L such that the outlet 32*a* of the nozzle 32 is retained at a higher level than the bottom face 34 of the base portion 10*a* of the housing 10. In other words, the axial length L of the nozzle 32 is shorter than the difference $\Delta H$ between the level of the lower face 36 of the overhang portion 10*b* and the level of the bottom face 34 of the base portion 10*a*.

Figure 6:
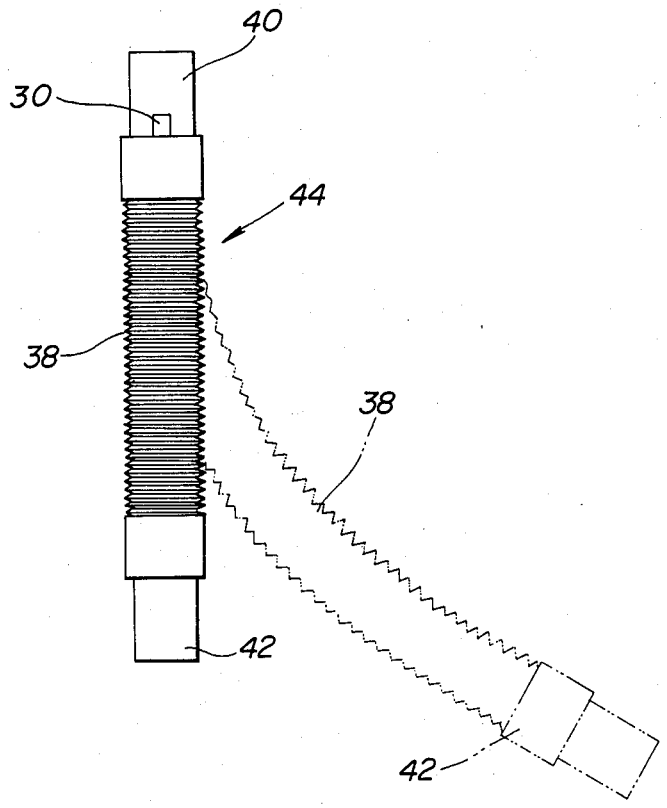
FIG. 6 is a front view of a modified form of the silencer tube in FIG. 3.

FIG. 6 illustrates a modified form of the silencer tube 2 in FIG. 3, which has a bellowslike portion 38 between the upper end portion 40 and the lower end portion 42. This bellowslike portion 38 of this silencer tube 44 is made of a pliant material such as a flexible plastic, and thus, as shown by the phantom line, the tube 44 is expandable, contractible and flexible. Accordingly, by attaching the tube 44 to the nozzle 1 or 32, it is possible to change the direction of the flow of the bubble-containing water in the bathtub.

In addition, the above-described bubble bath assembly works more effectively, if it is used together with the additive consisting of components including 60% of polyethylene glycol, 28% of sodium hydrogencarbonate, 11.5% of sodium sulfate anhydride, 0.5% of coloring matter and a very small amount of perfume. When a suitable amount of this additive is put into the bubble bath utilizing the bubble bath assembly, the properties of the additive and the bubbles including oxygen influence upon each other so that there is accelerated the formation of the layer of the bubbles over the bath water.

It is understood that although a preferred embodiment of the present invention has been shown and described, various modifications thereof will be apparent to those skilled in the art, and, accordingly, the scope of the present invention should be defined only by the appended claims and equivalents thereof.

What is claimed is:

1. A bubble bath assembly designed to be installed in the vicinity of the side wall of a conventional bathtub, and for creating a bubbling effect in the water in the bathtub, the bubble bath assembly comprising:

pump means for drawing water thereinto from the bathtub and for discharging water under pressure into the bathtub, the pump means having an inlet and an outlet;

a suction pipe member connected to the inlet of the pump means for leading water from the bathtub into the pump means therethrough, the suction pipe member being adapted to be disposed within the bathtub;

A nozzle member connected to the outlet of the pump means for discharging water in a jet therefrom;

support means holding the nozzle member for retaining the nozzle member over the water in the bathtub so that the jet of water is directed against the surface of the water in the bathtub when the pump means is operated, the support means including a housing enclosing the pump means, the housing to be mounted on the upper edge of the side wall of the bathtub; these housing including a base portion having a bottom face to rest on the upper edge of the side wall of the bathtub; and an overhang portion projecting from the base portion to overhang the water in the bathtub, the overhang portion having a lower face to be positioned at a higher level than the bottom face of the base portion upon the mounting of the housing, the nozzle member being attached to the lower face of the overhang portion in such a manner that an outlet of the nozzle member is directed downward upon the mounting of the housing wherein the outlet of the nozzle member is positioned at a higher level than the bottom face of the base portion upon the mounting of the housing.

2. A bubble bath assembly according to claim 1, wherein the base portion of the housing has a rear face to be attached to the wall of a bathroom in which the bathtub is installed.

3. A bubble bath assembly according to claim 1 or 2, further comprising a silencer tube coaxially attached at one end thereof to the nozzle member for reduction of noise due to the jet of water, the silencer tube having an axial length such that at least the other end of the silencer tube is immersed in the water in the bathtub upon the mounting of the housing and upon the filling up of the bathtub with water.

4. A bubble bath assembly according to claim 3, wherein the silencer tube has an air intake hole formed in the upper end portion thereof, for allowing the external air to come into the silencer tube therethrough.

5. A bubble bath assembly according to claim 4, wherein the silencer tube has a bellowslike portion between opposite ends thereof, whereby the silencer tube can be expanded, contracted and flexed.

* * * * *